US009731398B2

(12) United States Patent
Qian et al.

(10) Patent No.: US 9,731,398 B2
(45) Date of Patent: Aug. 15, 2017

(54) POLYURETHANE POLISHING PAD

(71) Applicants: Rohm and Haas Electronic Materials CMP Holdings, Inc., Newark, DE (US); Dow Global Technologies LLC, Midland, MI (US)

(72) Inventors: Bainian Qian, Newark (DE); Raymond L. Lavoie, Jr., Hockessin, DE (US); Marty W. DeGroot, Middletown, DE (US); Benson Lee, Miaoli County (TW)

(73) Assignees: Rohm and Haas Electronic Materials CMP Holding, Inc., Newark, DE (US); Dow Global Technologies LLC, Midland, MI (US)

( * ) Notice: Subject to any disclaimer, the term of this patent is extended or adjusted under 35 U.S.C. 154(b) by 54 days.

(21) Appl. No.: 14/465,934

(22) Filed: Aug. 22, 2014

(65) Prior Publication Data

US 2016/0052103 A1 Feb. 25, 2016

(51) Int. Cl.

| | |
|---|---|
| ***B24D 3/00*** | (2006.01) |
| ***B24D 11/00*** | (2006.01) |
| ***B24D 18/00*** | (2006.01) |
| ***B24B 1/00*** | (2006.01) |
| ***C09K 3/14*** | (2006.01) |
| ***B24B 37/24*** | (2012.01) |

(52) U.S. Cl.

CPC ..... *B24B 37/24* (2013.01)

(58) Field of Classification Search

USPC ..... 51/296, 293, 298

See application file for complete search history.

(56) References Cited

U.S. PATENT DOCUMENTS

| | | | | |
|---|---|---|---|---|
| 5,578,362 | A | 11/1996 | Reinhardt et al. | |
| 6,705,934 | B1 * | 3/2004 | Shiro | B24B 37/24 451/41 |
| 7,169,030 | B1 | 1/2007 | Kulp | |
| 2005/0064709 | A1 * | 3/2005 | Shimomura | B24B 37/24 438/689 |
| 2012/0122381 | A1 * | 5/2012 | Wank | B24B 37/24 451/526 |

FOREIGN PATENT DOCUMENTS

| | | |
|---|---|---|
| WO | 01/91971 | 12/2001 |

* cited by examiner

*Primary Examiner* — James McDonough
(74) *Attorney, Agent, or Firm* — Blake T. Biederman

(57) ABSTRACT

The polishing pad is for planarizing at least one of semiconductor, optical and magnetic substrates. The polishing pad includes a cast polyurethane polymeric material formed from a prepolymer reaction of $H_{12}$MDI/TDI with polytetramethylene ether glycol to form an isocyanate-terminated reaction product. The isocyanate-terminated reaction product has 8.95 to 9.25 weight percent unreacted NCO and has an $NH_2$ to NCO stoichiometric ratio of 102 to 109 percent. The isocyanate-terminated reaction product is cured with a 4,4'-methylenebis(2-chloroaniline) curative agent. The cast polyurethane polymeric material, as measured in a non-porous state, having a shear storage modulus, G' of 250 to 350 MPa as measured with a torsion fixture at 30° C. and 40° C. and a shear loss modulus, G" of 25 to 30 MPa as measured with a torsion fixture at 40° C. The polishing pad having a porosity of 20 to 50 percent by volume and a density of 0.60 to 0.95 g/cm$^3$.

8 Claims, 4 Drawing Sheets

POLYURETHANE POLISHING PAD

BACKGROUND

This specification relates to polishing pads useful for polishing and planarizing substrates and particularly to planarizing polishing pads having accelerated metal removal rates with low defect levels.

Polyurethane polishing pads are the primary pad-type for a variety of demanding precision polishing applications. These polyurethane polishing pads are effective for polishing silicon wafers, patterned wafers, flat panel displays and magnetic storage disks. In particular, polyurethane polishing pads provide the mechanical integrity and chemical resistance for most polishing operations used to fabricate integrated circuits. For example, polyurethane polishing pads have high strength for resisting tearing; abrasion resistance for avoiding wear problems during polishing; and stability for resisting attack by strong acidic and strong caustic polishing solutions.

The production of semiconductors typically involves several chemical mechanical planarization (CMP) processes. In each CMP process, a polishing pad in combination with a polishing solution, such as an abrasive-containing polishing slurry or an abrasive-free reactive liquid, removes excess material in a manner that planarizes or maintains flatness for receipt of a subsequent layer. The stacking of these layers combines in a manner that forms an integrated circuit. The fabrication of these semiconductor devices continues to become more complex due to requirements for devices with higher operating speeds, lower leakage currents and reduced power consumption. In terms of device architecture, this translates to finer feature geometries and increased metallization levels. In some applications, these increasingly stringent device design requirements are driving the adoption of increased number of tungsten interconnect plugs or vias in conjunction with new dielectric materials having lower dielectric constants. The diminished physical properties, frequently associated with low k and ultra-low k materials, in combination with the devices' increased complexity have led to greater demands on CMP consumables, such as polishing pads and polishing solutions.

In particular, low k and ultra-low k dielectrics tend to have lower mechanical strength and poorer adhesion in comparison to conventional dielectrics, rendering planarization more difficult. In addition, as integrated circuits' feature sizes decrease, CMP-induced defectivity, such as, scratching becomes a greater issue. Furthermore, integrated circuits' decreasing film thickness requires improvements in defectivity while simultaneously providing acceptable topography to a wafer substrate—these topography requirements demand increasingly stringent planarity, dishing and erosion specifications.

Casting polyurethane into cakes and cutting the cakes into several thin polishing pads has proven to be an effective method for manufacturing polishing pads with consistent reproducible polishing properties. Kulp et al., in U.S. Pat. No. 7,169,030, disclose the use of high tensile strength polishing pads to improve planarization while maintaining low defectivity. Unfortunately, polyurethane pads produced from these formulations lack the metal removal rate and low defectivity polishing properties necessary for the most demanding low defect polishing applications.

STATEMENT OF INVENTION

An aspect of the invention includes a polishing pad suitable for planarizing at least one of semiconductor, optical and magnetic substrates, the polishing pad comprising a cast polyurethane polymeric material formed from a prepolymer reaction of H12MDI/TDI with polytetramethylene ether glycol to form an isocyanate-terminated reaction product, the isocyanate-terminated reaction product having 8.95 to 9.25 weight percent unreacted NCO, having an NH2 to NCO stoichiometric ratio of 102 to 109 percent, the isocyanate-terminated reaction product being cured with a 4,4'-methylenebis(2-chlororaniline) curative agent, the cast polyurethane polymeric material, as measured in a non-porous state, having a shear storage modulus, G' of 250 to 350 MPa as measured with a torsion fixture at 30° C. and 40° C. and a shear loss modulus, G" of 25 to 30 MPa as measured with a torsion fixture at 40° C. (ASTM D5279) and the polishing pad having a porosity of 20 to 50 percent by volume and a density of 0.60 to 0.95 g/cm3.

Another aspect of the invention provides a polishing pad suitable for planarizing at least one of semiconductor, optical and magnetic substrates, the polishing pad comprising a cast polyurethane polymeric material formed from a prepolymer reaction of H12MDI/TDI with polytetramethylene ether glycol to form an isocyanate-terminated reaction product, the isocyanate-terminated reaction product having 8.95 to 9.25 weight percent unreacted NCO, having an NH2 to NCO stoichiometric ratio of 103 to 107 percent, the isocyanate-terminated reaction product being cured with a 4,4'-methylenebis(2-chlororaniline) curative agent, the cast polyurethane polymeric material, as measured in a non-porous state, having a shear storage modulus, G' of 250 to 350 MPa as measured with a torsion fixture at 30° C. and 40° C. and a shear loss modulus, G" of 25 to 30 MPa as measured with a torsion fixture at 40° C. (ASTM D5279) wherein a ratio of shear storage modulus, G' at 40° C. to shear loss modulus, G' at 40° C. is 8 to 15 and the polishing pad having a porosity of 20 to 50 percent by volume and a density of 0.60 to 0.95 g/cm3.

DETAILED DESCRIPTION

Figure 1:
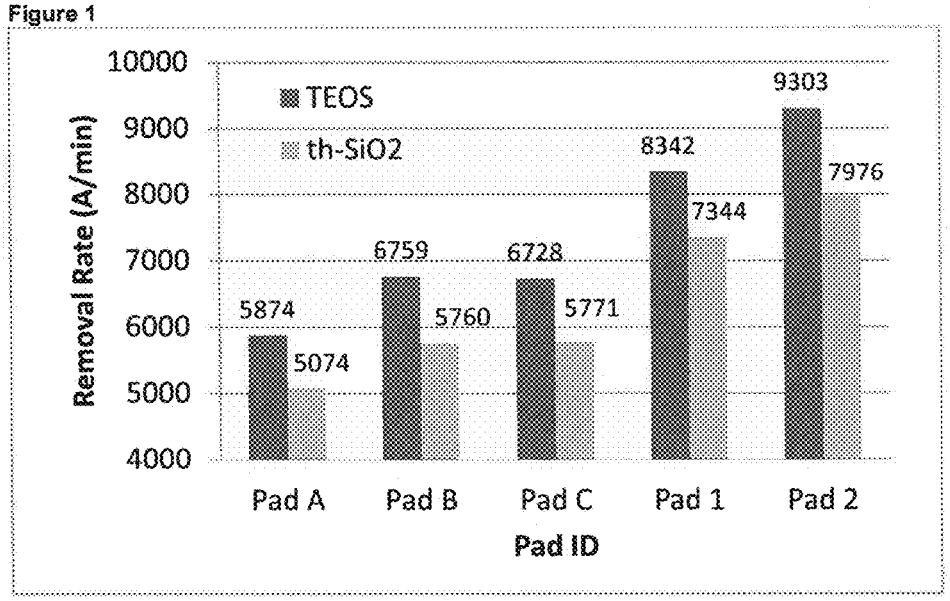
FIG. 1 is a bar graph that illustrates the improved TEOS dielectric removal rates achieved with polishing pads of the invention.

The polishing pad is suitable for planarizing at least one of semiconductor, optical and magnetic substrates. Most preferably, the pad is useful for polishing semiconductor substrates. Example wafer substrates where the pad has particular effectiveness include tungsten polishing and TEOS and shallow-trench-isolation or STI polishing with ceria particle-containing slurries. The polishing pad includes comprising a cast polyurethane polymeric material formed from a prepolymer reaction of H12MDI/TDI with polytetramethylene ether glycol to form an isocyanate-terminated reaction product. The isocyanate-terminated reaction product has 8.95 to 9.25 weight percent unreacted NCO and an NH2 to NCO stoichiometric ratio of 102 to 109 percent. Preferably, this stoichiometric ratio is 103 to 107 percent. The isocyanate-terminated reaction product is cured with a 4,4'-methylenebis(2-chlororaniline) curative agent.

The cast polyurethane polymeric material, as measured in a non-porous state, has a shear storage modulus, G' of 250 to 350 MPa, as measured with a torsion fixture at 30° C. and 40° C. and a shear loss modulus, G" of 25 to 30 MPa, as measured with a torsion fixture at 40° C. (ASTM D5279) at 10 rad/s frequency and 3° C./min temperature ramp. Preferably, the pad has a ratio of shear storage modulus, G' to shear loss modulus, G" of 8 to 15, as measured with a torsion fixture at 40° C. Most preferably, the pad has a ratio of shear storage modulus, G' to shear loss modulus, G" of 8 to 12 as measured at 40° C. This balance of shear storage modulus and shear loss modulus provides an excellent combination of high removal rate with low defectivity.

The polymer is effective for forming porous or filled polishing pads. For purposes of this specification, filler for polishing pads include solid particles that dislodge or dissolve during polishing, and liquid-filled particles or spheres. For purposes of this specification, porosity includes gas-filled particles, gas-filled spheres and voids formed from other means, such as mechanically frothing gas into a viscous system, injecting gas into the polyurethane melt, introducing gas in situ using a chemical reaction with gaseous product, or decreasing pressure to cause dissolved gas to form bubbles. The porous polishing pads contain a porosity or filler concentration of at least 0.1 volume percent. This porosity or filler contributes to the polishing pad's ability to transfer polishing fluids during polishing. Preferably, the polishing pad has a porosity or filler concentration of 20 to 50 volume percent. With respect to density, levels of 0.60 to 0.95 g/cm3 are effective. Preferably, density levels are 0.7 to 0.9 g/cm3 are effective.

At lower porosity, the polishing pad lacks the increased polishing removal rates. At higher porosity, the polishing pad lacks the stiffness requisite for demanding planarization applications. Optionally, the pores have an average diameter of less than 100 μm. Preferably, the pores or filler particles have a weight average diameter of 10 to 60 μm. Most preferably, the pores or filler particles have a weight average diameter of 15 to 50 μm.

Controlling the unreacted NCO concentration is particularly effective for controlling the pore uniformity for pores formed directly or indirectly with a filler gas. This is because gases tend to undergo thermal expansion at a much greater rate and to a greater extent than solids and liquids. For example, the method is particularly effective for porosity formed by casting hollow microspheres, either pre-expanded or expanded in situ; by using chemical foaming agents; by mechanically frothing in gas; and by use of dissolved gases, such as argon, carbon dioxide, helium, nitrogen, and air, or supercritical fluids, such as supercritical carbon dioxide or gases formed in situ as a reaction product.

EXAMPLES

Cast polyurethane cakes were prepared by the controlled mixing of (a) an isocyanate terminated prepolymer at 51° C. (or desired temperatures based on various formulations) obtained by the reaction of a polyfunctional isocyanate (i.e., toluene diisocyanate, TDI) and a polyether based polyol (for example, Adiprene® LF750D and others listed in Tables commercially available from Chemtura Corporation); (b) a curative agent at 116° C. and optionally, (c) a hollow core filler (i.e., Expancel® 551DE40d42, 461DE20d60, or 461DE20d70, available from Akzo Nobel). The ratio of the isocyanate terminated prepolymer and the curative agent was set such that the stoichiometry, as defined by the ratio of active hydrogen groups (i.e., the sum of the —OH groups and —NH2 groups) in the curative agent to the unreacted isocyanate (NCO) groups in the isocyanate terminated prepolymer, was set according to each formulation as listed in Tables. The hollow core filler was mixed into the isocyanate terminated prepolymer prior to the addition of a 4,4'-methylenebis(2-chlororaniline) curative agent. The isocyanate terminated prepolymer with the incorporated hollow core filler were then mixed together using a high shear mix head. After exiting the mix head, the combination was dispensed over a period of 3 minutes into an 86.4 cm (34 inch) diameter circular mold to give a total pour thickness of approximately 8 cm (3 inches). The dispensed combination was allowed to gel for 15 minutes before placing the mold in a curing oven. The mold was then cured in the curing oven using the following cycle: 30 minutes ramp of the oven set point temperature from ambient temperature to 104° C., then hold for 15.5 hours with an oven set point temperature of 104° C., and then 2 hour ramp of the oven set point temperature from 104° C. down to 21° C.

Table 1 includes the polishing pad formulations manufactured to the above method with various prepolymers, stoichiometries, pore size, pore volume and groove pattern. The cured polyurethane cakes were then removed from the mold and skived (cut using a moving blade) at a temperature of 30 to 80° C. into multiple polishing layers having an average thickness of 1.27 mm (50 mil) or 2.0 mm (80 mil). Skiving was initiated from the top of each cake.

Table 1 lists major properties of the polishing layer used in this study. The polishing layer pad examples 1 and 2 was finished with perforations (P) and perforations plus an AC24 overlay (P+AC24), respectively, for better slurry transport. Perforations had a diameter of 1.6 mm and a spacing of 5.4 mm in MD and 4.9 mm in XD arranged in a staggered pattern. The overlay AC24 is X-Y or square-type groove pattern having dimensions of 0.6 mm deep, 2.0 mm wide and 40 mm in pitch. A 1.02 mm (40 mil) thick Suba™ 400 subpad was stacked to the polishing layer. The polishing layer for pad examples 3 and 4 was finished with 1010 and K-7 circular grooves, respectively. The 1010 grooves had a width of 0.51 mm (20 mils), depth of 0.76 mm (30 mils) and a pitch of 3.05 mm (120 mils). The K-7 grooves had a width of 0.51 mm (20 mils), depth of 0.76 mm (30 mils) and a pitch of 1.78 mm (70 mils).

TABLE 1

| Pad | Prepolymer | Prepolymer (wt %) NCO | $NH_2$ to NCO stoichiometry (%) | Pore size (μm) | Volume Porosity (%) | Groove |
|---|---|---|---|---|---|---|
| 1 | Adiprene L325 | 8.95-9.25 | 105 | 20 | 36.4 | P |
| 2 | Adiprene L325 | 8.95-9.25 | 105 | 20 | 36.4 | P + AC24 |
| 3 | Adiprene L325 | 8.95-9.25 | 105 | 20 | 33.1 | 1010 |
| 4 | Adiprene L325 | 8.95-9.25 | 105 | 20 | 34.8 | K-7 |
| A | Adiprene L325 | 8.95-9.25 | 87 | 40 | 30.5 | P |
| B | Adiprene L325 | 8.95-9.25 | 87 | 40 | 30.5 | P + AC24 |
| C | Adiprene LF750D | 8.75-9.05 | 105 | 20 | 19.2 | P |
| D | Adiprene L325 | 8.95-9.25 | 87 | 20 | 33.6 | 1010 |
| E | Adiprene L325 | 8.95-9.25 | 87 | 40 | 31.4 | 1010 |
| F | Adiprene L325 | 8.95-9.25 | 105 | 20 | 15.7 | 1010 |
| G | Adiprene L325 | 8.95-9.25 | 87 | 20 | 17.9 | 1010 |
| H | Adiprene L325 | 8.95-9.25 | 87 | 40 | 30.4 | 1010 |
| I | Adiprene L325 | 8.95-9.25 | 87 | 20 | 33.0 | K-7 |
| J | Adiprene L325 | 8.95-9.25 | 87 | 40 | 29.7 | K-7 |
| K | Adiprene L325 | 8.95-9.25 | 87 | 40 | 39.1 | K-7 |
| L | Adiprene LF750D | 8.75-9.05 | 105 | 20 | 16.1 | K-7 |
| M | Adiprene LF750D/ Adiprene LFG740D (1:1 by weight) | 8.75-9.05/ 8.65-9.05 | 95 | 20 | 13.0 | K-7 |

Adiprene ® is a urethane prepolymer products of Chemtura Corporation.
Adiprene L325 is a urethane prepolymer of $H_{12}$MDI/TDI with polytetramethylene ether glycol (PTMEG) having an unreacted NCO of 8.95 to 9.25 wt %.
Adiprene LFG740D is a urethane prepolymer of TDI with ethylene oxide capped polypropylene glycol (PPG) having an unreacted NCO of 8.65 to 9.05 wt %.
Adiprene LF750D is a urethane prepolymer of urethane TDI - PTMEG prepolymer having an unreacted NCO of 8.75 to 9.05 wt %.

Oxide Blanket Wafer Polishing

The slurry used was a ceria based slurry having an average particle size of 0.1 μm, diluted with DI water at 1:9 ratio at the point of use for polishing. The polishing was carried out on a 300 mm CMP polishing system FREX300 by Ebara Technologies, Inc. Table 2 below summarizes the polishing conditions.

TABLE 2

| | |
|---|---|
| Polisher | FREX300(Ebara) |
| Head | G2S |
| Downforce | CAP/RAP/OAP/EAP/RRP/PCP: 500/500/500/500/650/250 [HPa] After Profile Adjustment: 500/500/450/400/650/250 [HPa] |
| TT/TP | 100/107 [rpm] |
| Slurry Flow Rate | 188 ml/min. |
| Polishing Time | Monitor/Dummy: 30 Sec. |
| Dresser | Asahi |
| Dressing | DF = 100N, Table 20 rpm, Dresser 16 rpm, Break-in: 600 s, Ex-situ 30 s |

Two types of oxide wafers were evaluated. They were TEOS oxide wafer formed by chemical vapor deposition (TEOS represents the decomposition product of tetraethyl orthosilicate) and a thermally grown oxide wafer (th-SiO2). The removal rates of the two types of oxide wafers are shown in FIG. 1 and summarized below in Table 3.

TABLE 3

| Pad | NH2 to NCO stoichiometry, (%) | Pore size (μm) | Volume Porosity, % | Grooves | TEOS RR (Å/min) | Thermal Oxide RR (Å/min) |
|---|---|---|---|---|---|---|
| 1 | 105 | 20 | 36.4 | P | 8342 | 7344 |
| 2 | 105 | 20 | 36.4 | P + AC24 | 9303 | 7976 |
| A | 87 | 40 | 30.5 | P | 5875 | 5074 |
| B | 87 | 40 | 30.5 | P + AC24 | 6759 | 5760 |
| C | 105 | 20 | 19.2 | P | 6728 | 5771 |

Figure 2:
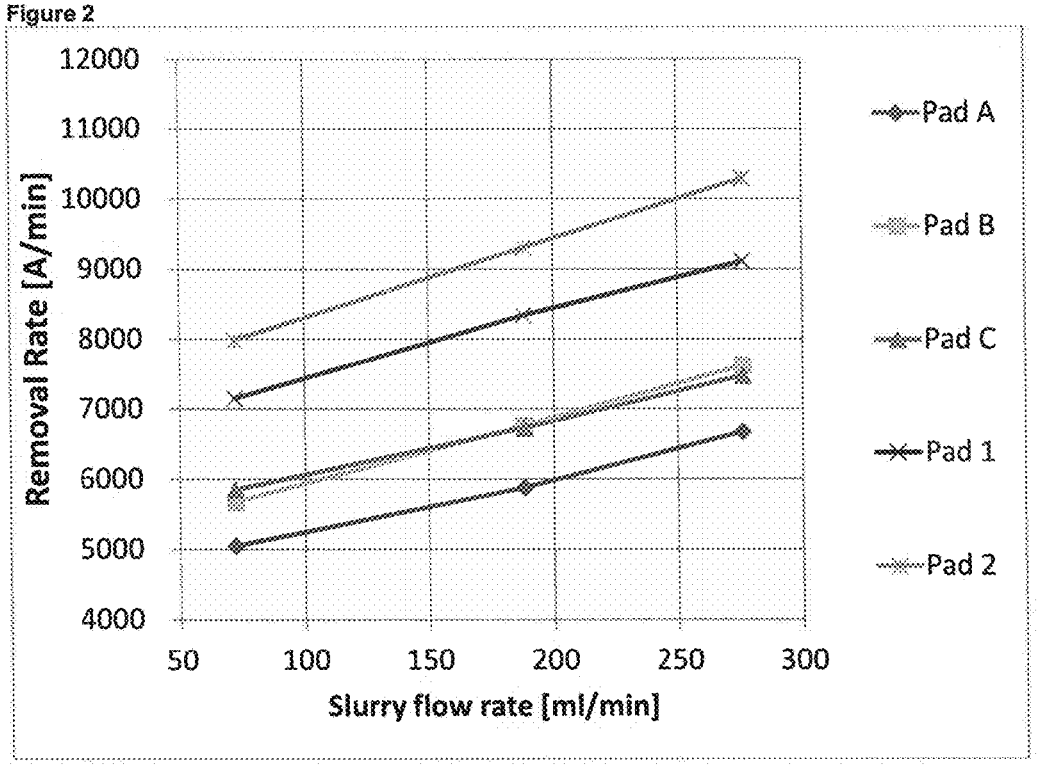
FIG. 2 is a plot that illustrates improved TEOS and thermal oxide dielectric removal rates achieved over a range of slurry flows.

For TEOS oxide wafers, removal rates were also evaluated at different slurry flow rates, with results shown in FIG. 2. Polishing pads with 105 percent stoichiometry have shown consistent higher TEOS removal rates at different slurry flow rates.

TEOS Patterned Wafer Polishing

Table 4 lists polishing pads used in pattern wafer study. The slurry used was a ceria based slurry having an average particle size of 0.1 μm, diluted with DI water at 1:9 ratio at the point of use for polishing. All pads had 1.27 mm (50 mil) perforated polishing layer and a stacked Suba 400 subpad. Polishing conditions for pattern wafer study are summarized in Table 5.

TABLE 4

| Pad | NH2 to NCO stoichiometry, % | Pore size (μm) | Volume Porosity, % | Grooves |
|---|---|---|---|---|
| 1 | 105 | 20 | 36.4 | P |
| A | 87 | 40 | 30.5 | P |
| C | 105 | 20 | 19.2 | P |

TABLE 5

| | |
|---|---|
| Polisher | FREX300(Ebara) |

TABLE 5-continued

| | |
|---|---|
| Head | G2S |
| Downforce | CAP/RAP/OAP/EAP/RRP/PCP: 500/500/500/500/650/250 [HPa] After Profile Adjustment: 500/500/450/400/650/250 [HPa] |
| TT/TP | 100/107 [rpm] |
| Slurry Flow Rate | 188 ml/min. |
| Polishing Time | Monitor/Dummy: 10 Sec. |
| Dresser | Asahi |
| Dressing | DF = 100N, Table 20 rpm, Dresser 16 rpm, Break-in: 600 s, Ex-situ 30 s |

Figure 3:
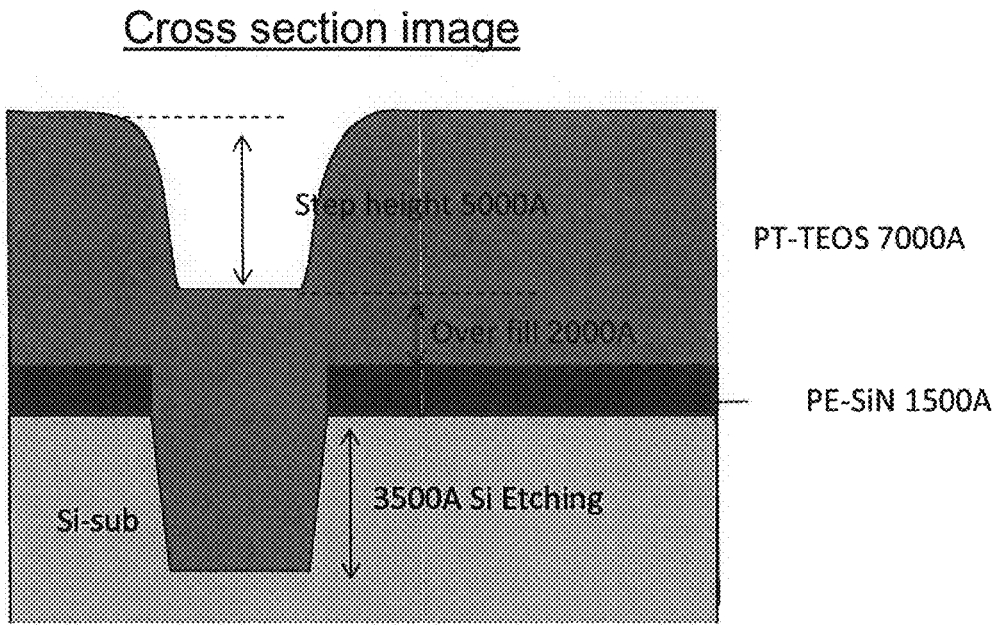
FIG. 3 is a schematic that illustrates the cross-section of a patterned wafer before chemical mechanical planarization.

The pattern wafer had a step height of 5000 Å (MIT-STI-764 pattern) formed by chemical vapor deposition of 7000 Å TEOS. The cross-section of a pattern wafer after TEOS deposition is illustrated in FIG. 3. Planarization efficiency was evaluated at line/space (L/S) of both 500 μm/500 μm and 25 μm/25 μm.

Figure 4:
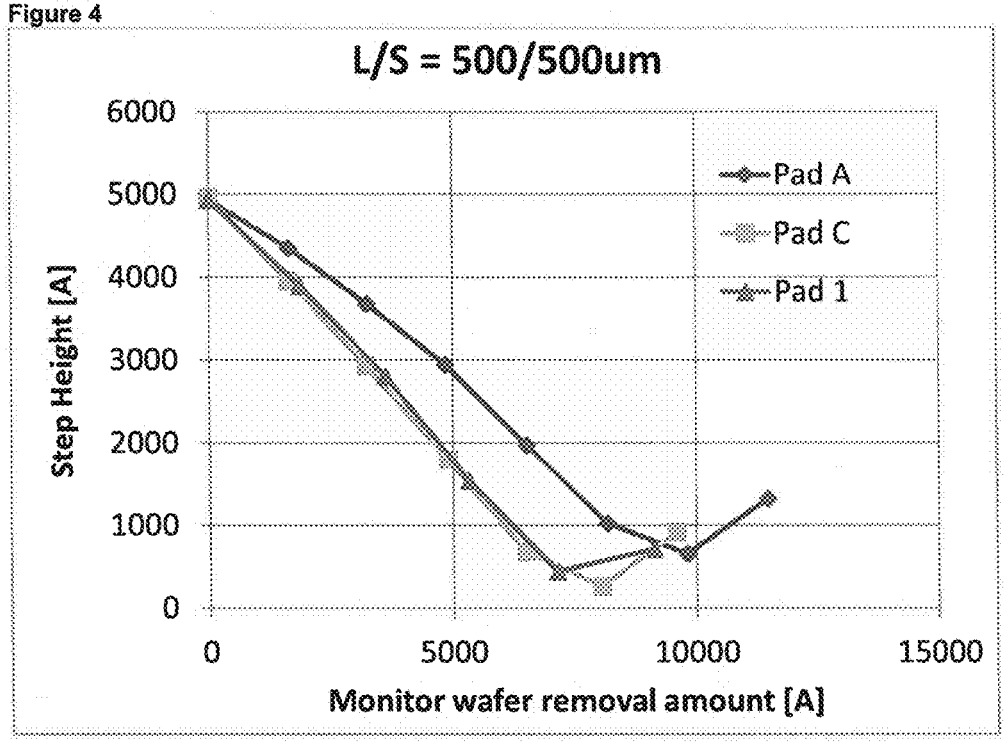
FIG. 4 illustrates wafer material removal required to reduce step height with a line/space (L/S) of 500 μm/500 μm.
Figure 5:
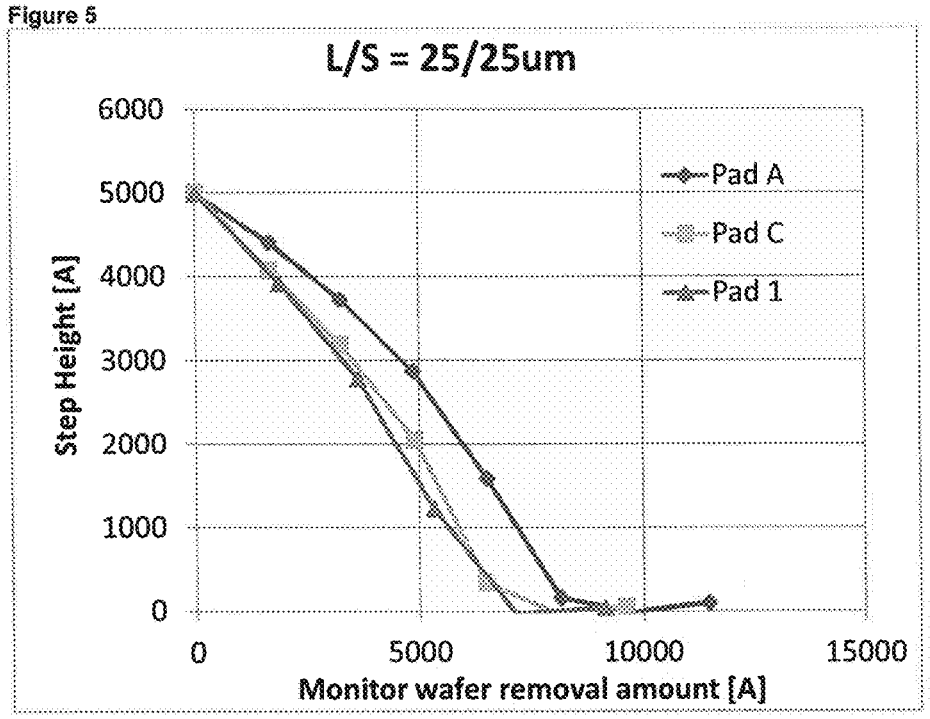
FIG. 5 illustrates wafer material removal required to reduce step height with a line/space (L/S) of 25 μm/25 μm.
Figure 6:
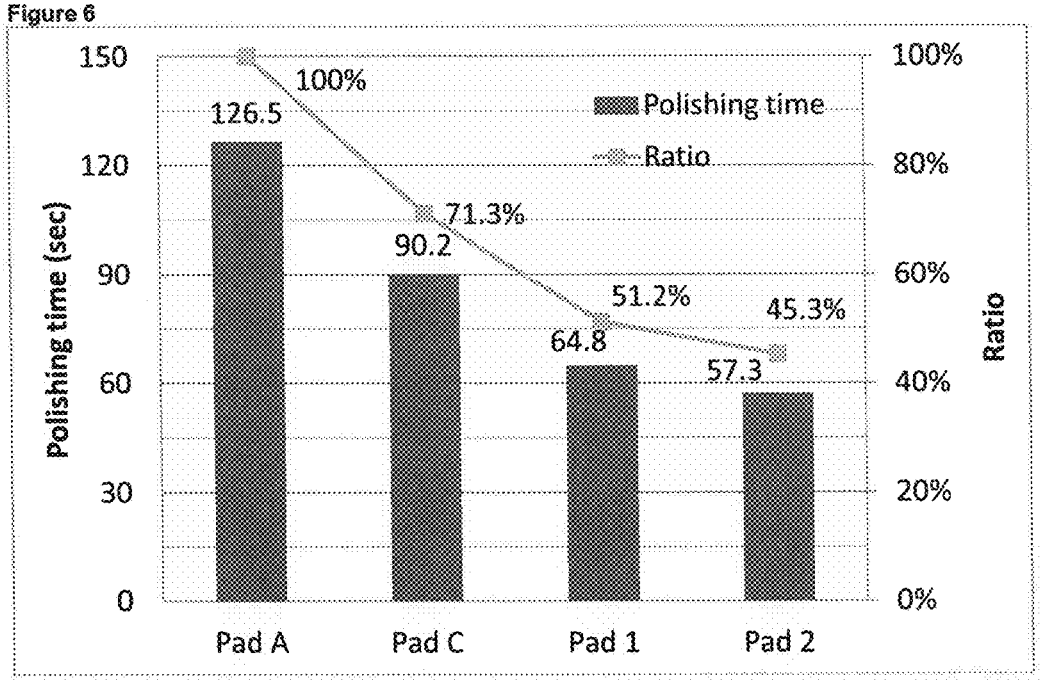
FIG. 6 is measure of time required to achieve planarization when polishing a patterned TEOS wafer.

The planarization efficiency of pad 1 was found better than the control pad A, and comparable to a less porous and more rigid control pad C, as shown in FIGS. 4 and 5. A faster step height reduction indicates better planarization efficiency. Furthermore, pad 1 had both high removal rate and good planarization efficiency. As a result, it can significantly reduce polishing time in achieving planarization, as shown in FIG. 6. The ratio represents polishing time for the pad in relation to control pad A. The lower the ratio, the more effective the pad in achieving planarization.

Tungsten Blanket Wafer Polishing

Tungsten polishing with 200 mm wafers was carried out in a Mirra™ polisher made by Applied Materials. Polishing conditions are summarized below for initial evaluation with Cabot SSW2000 tungsten slurry. The top pad was 2.03 mm (80 mil) thick, finished with 1010 grooves and a 1.02 mm (40 mil) thick Suba™ IV subpad.

Polishing conditions for tungsten 200 mm wafers:

Slurry: Cabot SSW2000 (1:2 dilution with deionized water at 2.0 wt % $H_2O_2$)

Slurry flow rate: 125 ml/min

Slurry drop point: ~66 mm from center

Conditioner: Saesol AM02BSL8031C1-PM

Pad Break-in: 113/93 rpm, 3.2 Kg-f (7 lb-f) CDF, 10 total zones, 3600 seconds

Ex-situ process: 113/93 rpm, 3.2 Kg-f (7 lb-f), 10 total zones, 10 s

Groove: 1010

Polishing Conditions

Down force: 29 kPa (4.2 psi)

Platen Speed: 113 rpm

Carrier speed: 111 rpm

Polish time: 60 seconds

Table 6 summarizes major pad properties and compares tungsten removal rate with Cabot SSW2000 slurry at 1:2 dilution with DI water and 2.0 wt % H2O2.

TABLE 6

| Pad | $NH_2$ to NCO stoichiometry, (%) | Pore size (μm) | Volume Porosity, (%) | Groove | W RR (Å/min) |
|---|---|---|---|---|---|
| 3 | 105 | 20 | 33.1% | 1010 | 4349 |
| D | 87 | 20 | 33.6% | 1010 | 3916 |
| E | 87 | 40 | 31.4% | 1010 | 3039 |
| F | 105 | 20 | 15.7% | 1010 | 3380 |
| G | 87 | 20 | 17.9% | 1010 | 3237 |
| H | 87 | 40 | 30.4% | 1010 | 2914 |

Figure 7:
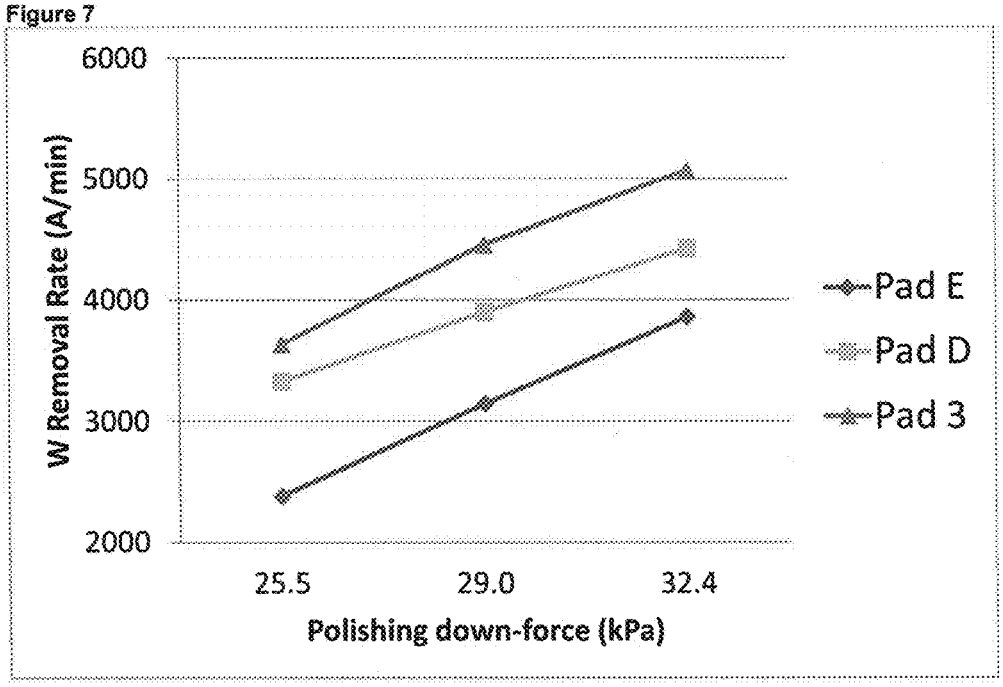
FIG. 7 plots tungsten removal rate versus carrier downforce in kPa.

Tungsten removal rates were significantly higher for pad 3 having a polishing layer for H12MDI/TDI with polytetramethylene ether glycol polishing pads cured with 4,4'-methylenebis(2-chlororaniline) curative agent having 105% stoichiometry and 33 volume percent pores. FIG. 7 shows pad 3 having higher tungsten removal rates at different polishing down forces.

In a second test series, Cabot SSW2000 slurry at a different dilution ratio (1:1.5 with DI water) and advanced tungsten slurry were also evaluated. Polishing conditions are summarized below.

Tool: Applied Mirra with Titan SP+ Head

Slurry 1: W2000 (1:1.5, 2.4 wt % $H_2O_2$), 70 ml/min

Slurry 2: Advanced tungsten slurry (1:1.8, 2.0 wt % $H_2O_2$), 100 ml/min

Conditioning Disk:

Kinik PDA32P-2N(IDG-2) for W2000 tests

3M A3700 for advanced tungsten slurry tests

Recipes with W2000

Pad break-in: 113/93 rpm, 5.0 Kg-f (11 lb-f) CDF, 10 total zones, 30 mins

Polish: 113/111 rpm, 29 kPa (4.2 psi), 60 s, 70 mL/min

Conditioning: ex-situ: 113/93 rpm, 5.0 Kg-f (11 lb-f) CDF, 10 total zones, 6 s

Recipes with Advanced Tungsten Slurry

Pad break-in: 80/36 rpm, 3.2 Kg-f (7 lb-f) CDF, 10 total zones, 30 mins

Polish: 80/81 rpm, 21.4 kPa (3.1 psi), 100 mL/min, 60 s

Conditioning: ex-situ: 80/36 rpm, 3.2 Kg-f (7 lb-f) CDF, 10 total zones, 24 s

Figure 8:
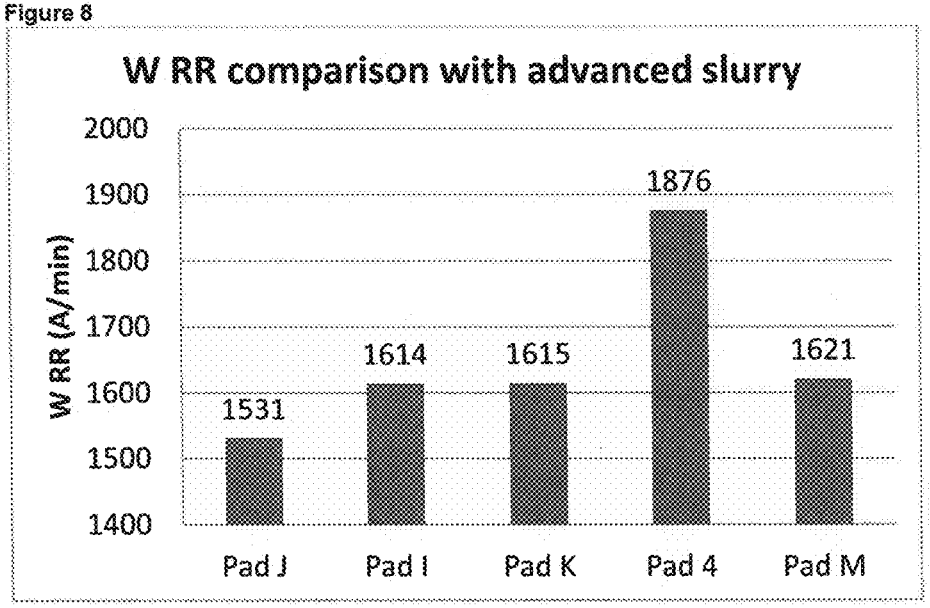
FIG. 8 is a bar graph illustrating improved tungsten removal rate of the invention.

All top pads were 2.03 mm (80 mil) thick and finished with circular K7 grooves and a 1.02 mm (40 mil) thick Suba IV sub pad. Table 7 summarizes major pad properties, tungsten removal rate and maximum polishing temperature of the different polishing pads. Tungsten removal rates are also shown in FIG. 8. Again, polishing pad from current invention showed significantly higher removal rate.

TABLE 7

| Pad | NH2 to NCO stoichiometry, (%) | Pore size (μm) | Volume Porosity, (%) | W2000 RR, (Å/min) | W2000 Maximum Temp. (° C.) | W* RR, (Å/min) | W* Maximum Temp. (° C.) |
|---|---|---|---|---|---|---|---|
| 4 | 105 | 20 | 34.8% | 5755 | 59 | 1876 | 39 |
| I | 87 | 20 | 33.0% | 4231 | 56 | 1614 | 36 |
| J | 87 | 40 | 29.7% | 3619 | 57 | 1531 | 33 |
| K | 87 | 40 | 39.1% | 4231 | 53 | 1615 | 33 |
| L | 105 | 20 | 16.1% | 4809 | 57 | NA | NA |
| M | 95 | 20 | 13.0% | 4585 | 50 | 1621 | 34 |

*= Advanced Tungsten Slurry

NA = Not Available

Maximum Temp represents the maximum temperature achieved during polishing.

Physical Properties

Matricies physical property data demonstrate range of criticality for H12MDI/TDI with polytetramethylene ether glycol cured with a 4,4'-methylenebis(2-chlororaniline) at 105% stoichiometry. Unfilled samples were made in the lab with stoichiometry ranging from about 87% to 115%. The hardness measurements were in accordance with ASTM-D2240 to measure Shore D hardness using a Shore S1, Model 902 measurement tool with a D tip at 2 seconds, then again at 15 seconds. Next storage shear modulus and loss shear modulus were measured with a torsion fixture at 10 rad/s frequency and 3° C./min temperature ramp from −100° C. to 150° C. (ASTM D5279). The shear modulus samples had a width of 6.5 mm, a thickness of 1.26 to 2.0 mm and a gap length of 20 mm. The test method for median tensile modulus (ASTM-D412) was measured from 5 specimens with geometry as follows: dumbbell shape with 4.5 inch (11.4 cm) in total length, 0.75 inch (0.19 cm) in total width, 1.5 inch (3.8 cm) in neck length and 0.25 inch (0.6 cm) in neck width. The grip separation was 2.5 (6.35 cm) inch with nominal gage length entered in the software of 1.5 inches (3.81 cm for neck), crosshead speed was at a rate of 20 inch/min. (50.8 cm/min.).

Physical properties are summarized in Tables 8 and 9.

TABLE 8

| Pad Sample | Stoichiometry | Density, g/cm 3 | Shore D at 2 sec | Shore D at 15 sec | G'@ 30° C., MPa | G'@ 40° C., MPa | G" 40° C,, MPa | G' 90° C., MPa |
|---|---|---|---|---|---|---|---|---|
| AA | 86.7% | 1.16 | 68 | 67 | 239 | 200 | 20.4 | 72.5 |
| BB | 91.8% | 1.16 | 71 | 70 | 256 | 216 | 23.9 | 81.1 |
| CC | 95.3% | 1.18 | 68 | 67 | 284 | 240 | 22.3 | 84.2 |
| DD | 100.5% | 1.17 | 71 | 69 | 281 | 237 | 26.2 | 85.7 |
| EE | 103.0% | 1.17 | 71 | 69 | 312 | 263 | 25.4 | 90.9 |
| FF | 105.2% | 1.15 | 71 | 69 | 323 | 270 | 26.8 | 92.4 |
| GG | 108.3% | 1.15 | 72 | 69 | 321 | 265 | 26.2 | 84.5 |
| HH | 110.8% | 1.16 | 71 | 69 | 297 | 246 | 26.3 | 76.9 |
| II | 117.4% | 1.17 | 67 | 66 | 269 | 215 | 26 | 60.7 |

TABLE 9

| Pad Sample | Stoichiometry | Median Tensile Strength, (psi) | Median Tensile Strength, (MPa) | Median Elastic Modulus (psi) | Median Elastic Modulus (MPa) | 25% Elongation Modulus (psi) | 25% Elongation Modulus (MPa) | 100% Elongation Modulus (psi) | 100% Elongation Modulus (MPa) |
|---|---|---|---|---|---|---|---|---|---|
| AA | 86.7% | 5372 | 37 | 57147 | 394 | 3905 | 27 | 4764 | 33 |
| BB | 91.8% | 5545 | 38 | 60635 | 418 | 4115 | 28 | 4836 | 33 |
| CC | 95.3% | 6011 | 41 | 62412 | 430 | 4282 | 30 | 4954 | 34 |
| DD | 100.5% | 5363 | 37 | 64914 | 448 | 4379 | 30 | 4907 | 34 |
| EE | 103.0% | 4790 | 33 | 67554 | 466 | 4450 | 31 | 4931 | 34 |
| FF | 105.2% | 4761 | 33 | 67216 | 464 | 4460 | 31 | 4927 | 34 |
| GG | 108.3% | 4622 | 32 | 64893 | 448 | 4319 | 30 | 4635 | 32 |
| HH | 110.8% | 4469 | 31 | 66564 | 459 | 4343 | 30 | 4577 | 32 |
| II | 117.4% | 4430 | 31 | 61026 | 421 | 4266 | 29 | 4302 | 30 |

In summary, the specific combination of formulation, shear storage modulus, shear loss modulus and porosity provides tungsten and TEOS polishing characteristics. Furthermore, this polishing pad has shown significantly higher removal rate in TEOS sheet wafer polishing than current industrial standards IC1000 or VP5000 polishing pads.

The invention claimed is:

1. A polishing pad suitable for planarizing at least one of semiconductor, optical and magnetic substrates, the polishing pad comprising a cast polyurethane polymeric material formed from a prepolymer reaction of $H_{12}$MDI/TDI with polytetramethylene ether glycol to form an isocyanate-terminated reaction product, the isocyanate-terminated reaction product having 8.95 to 9.25 weight percent unreacted NCO, having an $NH_2$ to NCO stoichiometric ratio of 102 to 109 percent and being surfactant and foaming agent free, the isocyanate-terminated reaction product being cured with a 4,4'-methylenebis(2-chlororaniline) curative agent, the cast polyurethane polymeric material, as measured in a non-porous state, having a shear storage modulus, G' of 250 to 350 MPa as measured with a torsion fixture at 30° C. and 40° C. and a shear loss modulus, G" of 25 to 30 MPa as measured with a torsion fixture at 40° C. (ASTM D5279) and the polishing pad including hollow microspheres having an average diameter of 20 μm and the polishing pad having a porosity of 20 to 50 percent by volume and a density of 0.60 to 0.95 g/cm$^3$.

2. The polishing pad of claim 1 wherein a ratio of shear storage modulus, G' at 40° C. to shear loss modulus, G" at 40° C. is 8 to 15.

3. The polishing pad of claim 1 wherein the isocyanate-terminated reaction product and the 4,4'-methylenebis(2-chlororaniline) has the $NH_2$ to NCO stoichiometric ratio of 103 to 107 percent.

4. The polishing pad of claim 1 wherein the density is 0.7 to 0.9 g/cm$^3$.

5. A polishing pad suitable for planarizing at least one of semiconductor, optical and magnetic substrates, the polishing pad comprising a cast polyurethane polymeric material formed from a prepolymer reaction of $H_{12}$MDI/TDI with polytetramethylene ether glycol to form an isocyanate-terminated reaction product, the isocyanate-terminated reaction product having 8.95 to 9.25 weight percent unreacted NCO, having an $NH_2$ to NCO stoichiometric ratio of 103 to 107 percent and being surfactant and foaming agent free, the isocyanate-terminated reaction product being cured with a 4,4'-methylenebis(2-chlororaniline) curative agent, the cast polyurethane polymeric material, as measured in a non-porous state, having a shear storage modulus, G' of 250 to 350 MPa as measured with a torsion fixture at 30° C. and 40° C. and a shear loss modulus, G" of 25 to 30 MPa as measured with a torsion fixture at 40° C. (ASTM D5279) wherein a ratio of shear storage modulus, G' at 40° C. to shear loss modulus, G' at 40° C. is 8 to 15 and the polishing pad including hollow microspheres having an average diameter of 20 μm and the polishing pad having a porosity of 20 to 50 percent by volume and a density of 0.60 to 0.95 g/cm$^3$.

6. The polishing pad of claim 5 wherein a ratio of shear storage modulus, G at 40° C. to shear loss modulus, G" at 40° C. is 8 to 12.

7. The polishing pad of claim 5 wherein the isocyanate-terminated reaction product and the 4,4'-methylenebis(2-chlororaniline) has the $NH_2$ to NCO stoichiometric ratio of 104 to 106 percent.

8. The polishing pad of claim 5 wherein the density is 0.70 to 0.80 g/cm$^3$.

* * * * *